US008539638B2

(12) United States Patent
Bertram et al.

(10) Patent No.: US 8,539,638 B2
(45) Date of Patent: Sep. 24, 2013

(54) FILTER AND VACUUM CLEANER HAVING SUCH A FILTER

(75) Inventors: Andre Bertram, Bielefeld (DE); Seyfettin Kara, Spenge (DE); Monika Seifert, Detmold (DE); Stefan Tiekoetter, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 348 days.

(21) Appl. No.: 13/094,869

(22) Filed: Apr. 27, 2011

(65) Prior Publication Data

US 2011/0271479 A1 Nov. 10, 2011

(30) Foreign Application Priority Data

May 5, 2010 (DE) ..... 10 2010 016 788

(51) Int. Cl.
*A47L 9/10* (2006.01)

(52) U.S. Cl.
USPC ..... 15/339; 15/327.7

(58) Field of Classification Search
USPC ..... 15/339, 347, 327.6, 327.7; 96/416, 96/417; 55/DIG. 34
See application file for complete search history.

(56) References Cited

U.S. PATENT DOCUMENTS

| | | | | |
|---|---|---|---|---|
| 4,530,706 | A * | 7/1985 | Jones | 96/117.5 |
| 6,315,821 | B1 * | 11/2001 | Pillion et al. | 96/416 |
| 6,497,756 | B1 * | 12/2002 | Curado et al. | 96/117.5 |
| 7,442,237 | B1 * | 10/2008 | Gardner | 96/117.5 |
| 7,875,100 | B2 * | 1/2011 | Wright | 95/8 |
| 8,225,782 | B2 * | 7/2012 | Rakow et al. | 128/201.25 |
| 2004/0216264 | A1 * | 11/2004 | Shaver et al. | 15/344 |
| 2004/0240324 | A1 | 12/2004 | Isbitsky | |

FOREIGN PATENT DOCUMENTS

| | | | |
|---|---|---|---|
| DE | 10229796 | A1 | 1/2004 |
| DE | 60205753 | T2 | 6/2006 |
| EP | 0396803 | A1 | 11/1990 |

* cited by examiner

*Primary Examiner* — Dung Van Nguyen
(74) *Attorney, Agent, or Firm* — Leydig, Voit & Mayer, Ltd.

(57) ABSTRACT

A filter includes a filter medium, a filter inlet side, a filter outlet side and an indicator device. The indicator device is configured to be acted upon by air flow through the filter and is disposed adjacent to the filter medium and extends from the filter inlet side to the filter outlet side. The indicator device includes an air path starting from the filter inlet side, a viewing window covering the air path on the filter outlet side, and a flow-through usage indicator configured to receive filtered material and disposed in the air path and visible beneath the viewing window on the filter outlet side.

18 Claims, 6 Drawing Sheets

FILTER AND VACUUM CLEANER HAVING SUCH A FILTER

CROSS REFERENCE TO RELATED APPLICATIONS

This application claims priority to German Patent Application No. DE 10 2010 016 788.6, filed May 5, 2010, which is hereby incorporated by reference herein in its entirety.

FIELD

The present invention relates to a filter with an indicator device which is acted upon by the air to be filtered and in which filtered material serves as an indicator.

BACKGROUND

EP 0 396 803 A1 describes a filter with an indicator device that is acted upon by air to be filtered and that displays a degree of saturation of the filter.

Vacuum cleaners, in particular electric vacuum cleaners designed for use in the home, nearly exclusively use multistage particulate filters. Typically, a pre-filter, preferably in the form of a dust bag, is provided upstream of a vacuum cleaner fan, and an exhaust filter is disposed downstream thereof to remove fine dust that has passed through the dust bag. The exhaust filter also collects, for example, the particles which are abraded from the carbon brushes or the like of the drive motor of the fan. Both filter stages are consumable items, which need to be replaced by a user of the vacuum cleaner. To this end, it is advantageous to give the user a reliable and usage-based indication of when the bag or the exhaust filter needs to be replaced as a result of an upper limit for the fill level or saturation being reached. For the dust bag, it is common to use sensors which operate based on the differential pressure principle. For the exhaust filter, it is known to use the time of use of the filter as a criterion for determining when replacement is necessary. For this purpose, a time counter may be used which is manually reset by the user after insertion of the exhaust filter and which, after a predetermined operating time has elapsed, indicates that the filter needs to be replaced. The algorithm and the controls and indicators needed for this are implemented in and form part of a vacuum cleaner control system.

German Patent Publication DE 102 29 796 describes a filter having a usage indicator which operates based on temperature-dependent integration. The color of the indicator changes in a temperature-dependent manner each time the vacuum cleaner is used for a prolonged period of time. German Patent Publication DE 602 057 53 T2 describes time-dependent usage indicators which need to be activated by a user by opening a liquid reservoir. A colored indicator liquid diffuses into an absorbent material which is provided in the usage indicator and which then changes color as a function of time and, therefore, is a measure for the period of use.

FIG. 1 shows, in a simplified schematic form, a conventional vacuum cleaner 10 having a dust chamber 12 in which may be positioned a dust bag 14. Dust 18 is conveyed through a suction hose 16 to dust bag 14 and collected therein. Dust 18 is transported by air flow 20, which is generated by a fan 22 (vacuum cleaner fan). Dust chamber 12 is closed by a dust chamber cover 24. Finer fractions of dust 18, which pass through dust bag 14, are carried into a vacuum cleaner exhaust filter 26 by the exhaust air or vacuum air flow 20 of fan 22.

Vacuum cleaner 10 includes a control processor 28, which is in operative connection with a control and display unit 30 disposed on vacuum cleaner 10. The signals from control and display unit 30 are used by control processor 28 to adjust the suction power of fan 22, and thus, the amount of dust 18 that can be picked up by vacuum cleaner 10.

In some designs of conventional vacuum cleaners 10, an indication of an upcoming need to replace vacuum cleaner exhaust filter 26 is provided by control and display unit 30 based on, for example, the accumulated operating time of vacuum cleaner 10, which is determined by control processor 28. In a vacuum cleaner 10 having such a function, the operating time meter is reset via control and display unit 30 after replacement of vacuum cleaner exhaust filter 26.

However, when the time of use is used as a criterion for determining when a filter needs to be replaced, the load actually placed on the filter is not, or not optimally, taken into account, because the linear time progression alone is not able to reproduce the actual usage behavior, which varies over time.

SUMMARY

In an embodiment, the present invention provides a filter including a filter medium, a filter inlet side, a filter outlet side and an indicator device. The indicator device is configured to be acted upon by air flow through the filter and is disposed adjacent to the filter medium and extends from the filter inlet side to the filter outlet side. The indicator device includes an air path starting from the filter inlet side, a viewing window covering the air path on the filter outlet side, and a flow-through usage indicator configured to receive filtered material and disposed in the air path and visible beneath the viewing window on the filter outlet side.

BRIEF DESCRIPTION OF THE DRAWINGS

An exemplary embodiment of the present invention will be described in more detail below with reference to the drawing. Corresponding objects or elements are identified by the same reference numerals in all figures. It is understood that neither this or any other exemplary embodiment should be construed as limiting the scope of the present invention. Rather, within the framework of the present disclosure, numerous revisions and modifications are possible, in particular such variants, elements and combinations, which, for example, by combining or altering individual features or elements or method steps described in connection with the general description and the, or each, particular embodiment, as well as the claims, and contained in the drawings, may be inferred by one skilled in the art with regard to achieving the objective, and lead, through combinable features, to a new subject matter or to new method steps or sequences of method steps. In the drawings:

DETAILED DESCRIPTION

Figure 1:
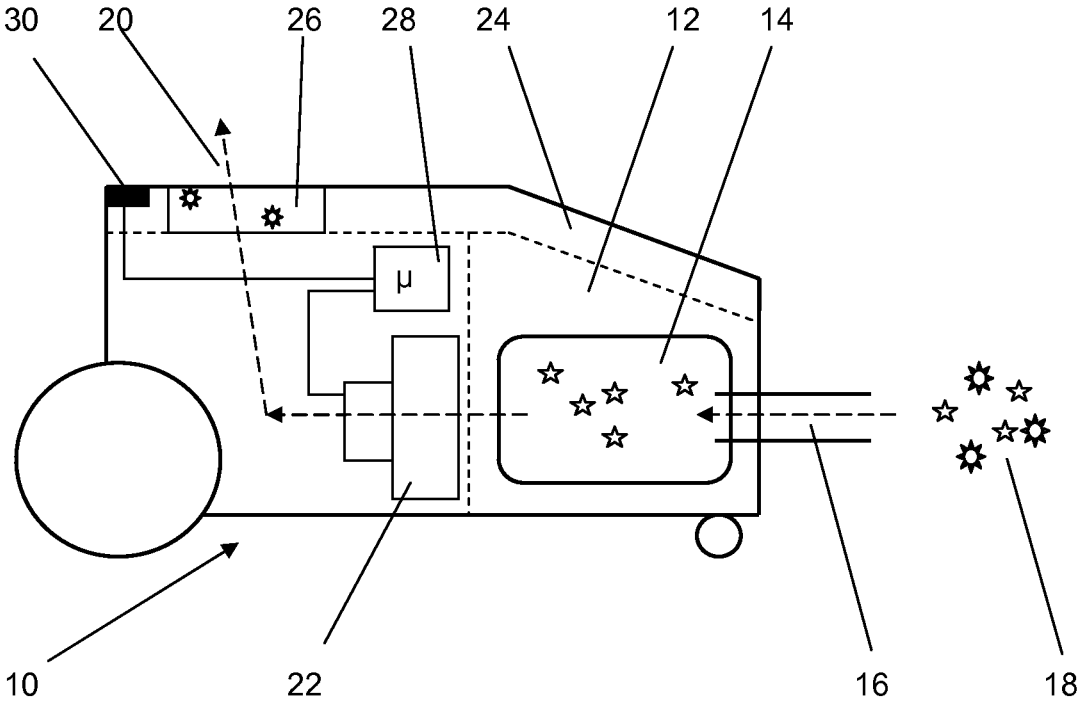
FIG. 1 shows a conventional vacuum cleaner.

In an embodiment, an aspect of the present invention is to provide a filter with a device for generating a filter replacement or fill level signal that corresponds to the level of usage, or to the degree of saturation.

In an embodiment, the present invention provides a filter that may be used as a vacuum cleaner exhaust filter; i.e., a filter which is disposed in the exhaust air stream of the suction fan of an electric vacuum cleaner and functions, for example, as a fine particulate filter or hygiene filter and which is sometimes also referred to as "exhaust port filter" or "after-filter".

An embodiment of the present invention provides a filter including at least one filter medium, a filter inlet side and a filter outlet side, the indicator device is advantageously acted upon by the air to be filtered. To achieve this, the indicator device is adjacent to at least one side of the or each filter medium and extends from the filter inlet side to the filter outlet side; the indicator device including an air path which starts at the filter inlet side and is covered by a viewing window on the filter outlet side; and a flow-through usage indicator located in the air path being visible beneath the viewing window on the filter outlet side. The usage indicator visible beneath the viewing window is used, for example, to collect the filtered material, and thus serves to indicate when the filter needs to be replaced or to monitor the fill level of the filter.

Accordingly, the filtered material itself is used for indicating when the filter needs to be replaced or for monitoring the fill level the filter. For this purpose, the indicator device is acted upon by the air to be filtered, so that material filtered from the air to be filtered can be collected in or on the indicator device and, as the amount of filter material increases, indicates the increasing degree of saturation of the filter.

The viewing window preferably bounds the air path of the indicator device on the filter outlet side, so that the air path is confined in this region and none of the air to be filtered and to act upon the indicator device can emerge in an uncontrolled manner from the filter and/or the indicator device. If the viewing window also functions as a deflector for the air flowing in the air path so that the air flow is directed through the usage indicator, the viewing window performs two functions at the same time, namely confining the air path at the filter outlet side and diverting the air flow through the usage indicator. The diversion of the air flow through the usage indicator causes the indicator device; i.e., the usage indicator forming part of the indicator device, to be acted upon by the air to be filtered. Since the usage indicator changes color according to the amount of filtered material collected, the color change occurring during deposition of such material on the usage indicator serves as a means for indicating when the filter needs to be replaced or for monitoring the fill level the filter.

If the air path leads from the viewing window via the flow-through usage indicator to the filter inlet side, the air to be filtered that is passed through the air path can be fed to the filter medium along with the remaining air, so that a common outlet is provided for both the air that flows through the filter medium directly and that which flows through the filter medium indirectly.

If, in the region of the filter inlet side, the air path terminates in a channel section oriented parallel to the filter inlet side, the end of the channel section functions as a nozzle directed toward the remainder of the filter. Because of the incident flow entering directly into the filter medium, this nozzle acts as a Venturi nozzle, as a result of which negative pressure is created at the outlet of the air path. Due to the negative pressure, the air to be filtered is drawn into the indicator device.

In an alternative embodiment, the air path leads via the usage indicator to the filter outlet side. In this case, preferably, an effective width of an inlet opening of the flow path at the filter inlet side is greater than an effective width of an outlet opening of the flow path, so that a sufficient amount of air which is to be filtered and which carries the medium to be filtered enters the indicator device and acts thereupon.

An embodiment of the invention includes a symmetric, in particular mirror-symmetric, arrangement of two air paths, which each include a viewing window and a usage indicator, or which have a common viewing window and a common usage indicator, and which may or may not have a separating layer provided therebetween. In a symmetric arrangement of two or more air paths, it is also possible to increase the effective width of an inlet opening of an air path at the filter inlet side. In addition, a symmetric, in particular mirror-symmetric, arrangement of two air paths which each include a viewing window and a usage indicator provides favorable conditions for the reading of the, or each, usage indicator because of the increased size of the viewing window. Specifically, it may be possible to read each of the usage indicators from different viewing angles. This facilitates the use of the filter and the indicator device thereof.

Reading of the usage indicator, and thus the use of the filter/of the indicator device, may also be facilitated if the viewing window includes a lens, in particular a lens having a suitably selected focal point to provide an enlarged representation of the usage indicator.

The filter discussed herein and described below may be used, in particular, in a vacuum cleaner, in particular an electric vacuum cleaner. Accordingly, in an embodiment, the present invention relates to a vacuum cleaner having a filter as described herein. The filter is particularly suited for electric vacuum cleaners because it retains small amounts of graphite, which is abraded from the carbon brushes of the fan motor. During the use of a conventional filter, this and other filtered material normally accumulates on the underside of the filter, where it changes the color thereof. However, this change in color is usually not perceived by the user, because the underside of the filter is not visible when in the installed position. In addition, the underside of the filter is usually covered by a dark, activated carbon-containing layer, so that accumulations of dirt are rather unlikely to attract the attention of the eye. In a filter having an indicator device which is disposed adjacent to one side of the filter medium and includes an air path in which is disposed a flow-through usage indicator, graphite particles enter the air path and are carried to the usage indicator therein, which takes the form of, for example, a fibrous filter mat, in particular a white panel filter, so that the usage indicator changes color over the useful life of the filter, and does so as a function of the amount of filtered material depositing therein. This change in color is visually perceivable by the user, allowing him or her to read the state of usage therefrom and to infer a need to replace the filter.

Overall, therefore, in an embodiment, the present invention also relates to the use of a filter, as discussed herein and described below, as a vacuum cleaner exhaust filter in the exhaust air stream of a suction fan of an electric vacuum cleaner.

In an embodiment, the present invention provides an indicator device in which a change in color or in a different optical property of a usage indicator provided on vacuum cleaner exhaust filter 26, or combined with vacuum cleaner exhaust filter 26 in a different suitable manner, may be controlled by a quantity which correlates with the amount of dust picked up by vacuum cleaner 10, and thus with the transfer of dust into exhaust filter 26, so as to implement a filter replacement indicator or filter fill level indicator that is based on the level of usage; i.e., saturation.

Figure 2:
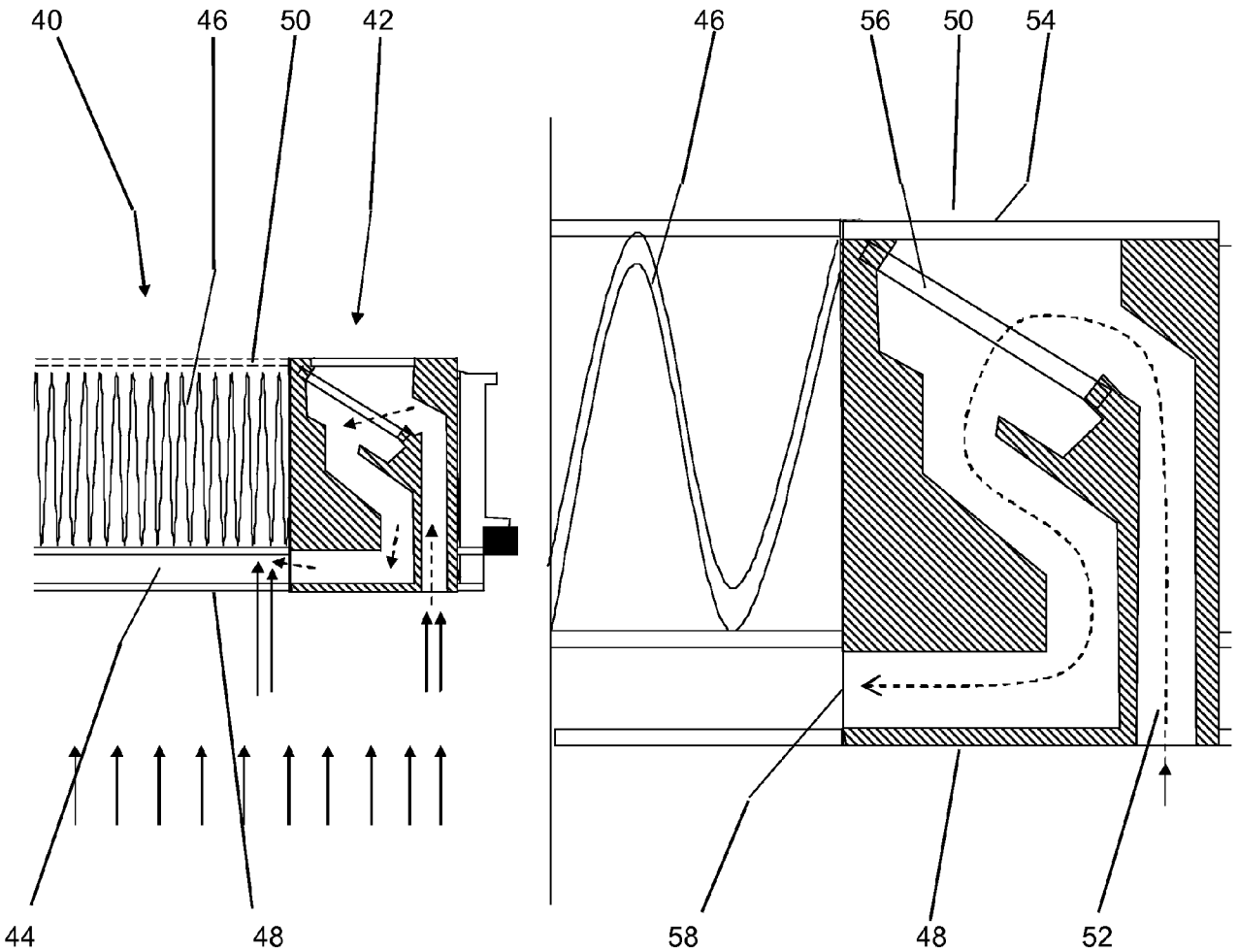
FIG. 2 shows a filter including an indicator device according to an embodiment of the present invention.

In this regard, FIG. 2 illustrates a filter 40 according to an embodiment of the present invention in a simplified schematic form, using the example of a vacuum cleaner exhaust filter 26 in the form of a HEPA filter. Accordingly, the partially visible filter 40 includes an indicator device 42, which is acted upon by the air to be filtered and in which filtered material serves as an indicator. In the right portion of the figure, filter 40 including indicator device 42 is shown in an enlarged view.

Filter 40, as illustrated, includes at least one filter medium, here a carbon filter 44 and a fibrous filter mat 46. According to its geometry and installation direction, the filter has a filter inlet side 48 and a filter outlet side 50. On filter inlet side 48, the air which is to be filtered during operation of filter 40 is represented by a plurality of parallel arrows directed toward filter 40. Indicator device 42 is adjacent to at least one side of filter 40, or of the or each filter medium, and extends from filter inlet side 48 to filter outlet side 50. The indicator device includes an air path 52, which starts at filter inlet side 48 and is covered by a viewing window 54 on filter outlet side 50. On filter outlet side 50, a flow-through usage indicator 56 is located in air path 52 beneath viewing window 54 in a position visible to a user. Filtered material serves as an indicator because it is trapped by flow-through usage indicator 56, where it remains visible, for example, due to different optical properties. If flow-through usage indicator 56 takes the form of, for example, a light-colored, in particular white, fibrous mat, fine dust, in particular particles which are abraded from the carbon brushes of the drive motor of vacuum cleaner fan 22, stands out thereagainst with high contrast, so that the resulting change in a color of the surface of flow-through usage indicator 56 serves as a measure for a saturation of the overall filter 40, or as an indication that filter 40 has reached a saturation limit.

During operation of filter 40, as can be seen in the enlarged view on the right, which shows a portion of filter 40 including indicator device 42, viewing window 54 functions as a deflector for the air flowing in air path 52 so as to direct it through or into usage indicator 56. In the case of an air path 52 having the geometry shown in FIG. 2, the air path leads from viewing window 54 via flow-through usage indicator 56 to filter inlet side 48. In particular, in the region of filter inlet side 48, air path 52 terminates in a channel section oriented parallel to filter inlet side 48, so that the end of the channel section functions as a nozzle 58 (Venturi nozzle) directed toward the remainder of the filter. During operation, the end of the channel section which is oriented parallel to filter inlet side 48 and acts as a Venturi nozzle produces a Venturi effect, creating negative pressure at the end of air path 52 so that, due to this negative pressure, the air to be filtered is drawn into air path 52.

Figure 3:
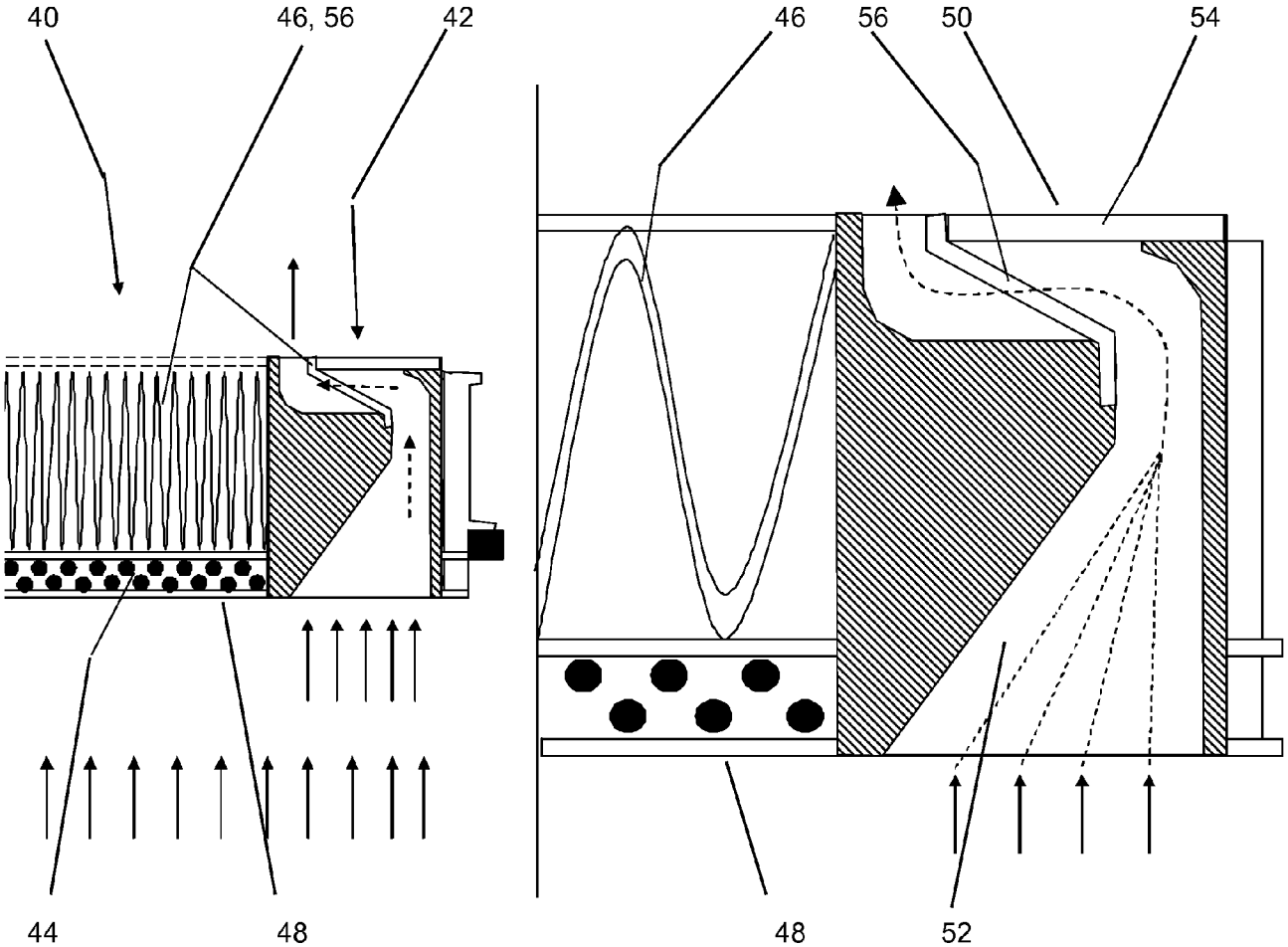
FIG. 3 shows another embodiment of a filter including an indicator device.

In a manner similar to FIG. 2, FIG. 3 shows a filter 40 including an indicator device 42, in which air path 52 leads via flow-through usage indicator 56 to filter outlet side 50. Apart from that, the components are the same as those shown in FIG. 2. Here, viewing window 54 and the end of air path 52 are both located at the surface of indicator device 42 that forms filter outlet side 50. In the embodiment shown, an effective width of an inlet opening of flow path 52 at the filter inlet side is greater than an effective width of an outlet opening of flow path 52. With regard to a practical ratio of the size of the inlet that of the outlet, the inlet size may be twice, three times, four times, etc., that of the outlet.

Figure 4:
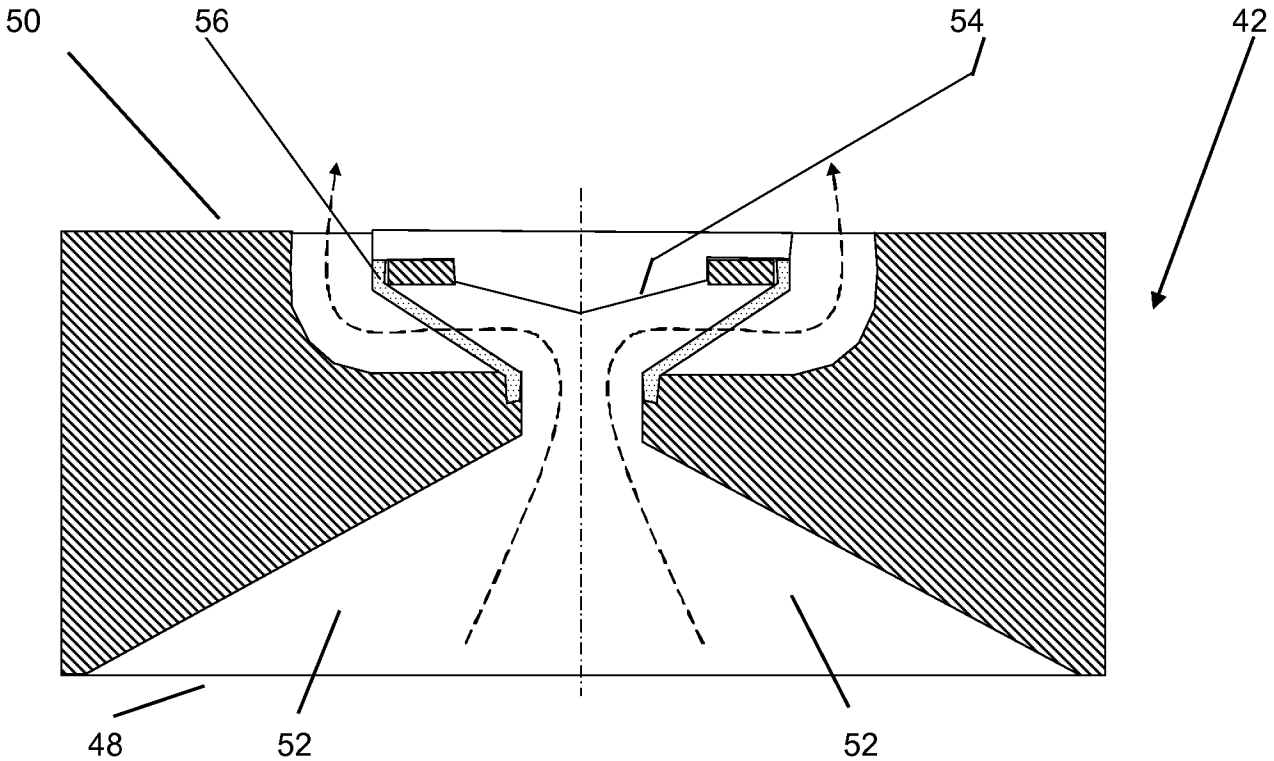
FIG. 4 shows another embodiment of an indicator device.

FIG. 4 shows a specific embodiment of indicator device 42 without a laterally adjacent or surrounding filter 40 (FIG. 2; FIG. 3). This embodiment includes a symmetric, in particular mirror-symmetric, arrangement of two air paths 52, which each include a viewing window 54 and a flow-through usage indicator 56. It is possible to use several viewing windows 54 and several flow-through usage indicators 56 for each of the symmetrically arranged air paths 52, or to use one common viewing window and/or one common usage indicator. Moreover, a separating layer may be provided between the at least two symmetrically arranged air paths 52. The dashed arrows indicate the flow path of the air to be filtered, so that in this configuration, too, indicator device 42 is acted upon by the air to be filtered. Since the air to be filtered flows through the or each usage indicator 56, and because filtered material is trapped by the or each usage indicator, in this configuration of indicator device 42, too, filtered material serves as an indicator for a degree of saturation of the filter 40 combined with the indicator device.

Figure 5:
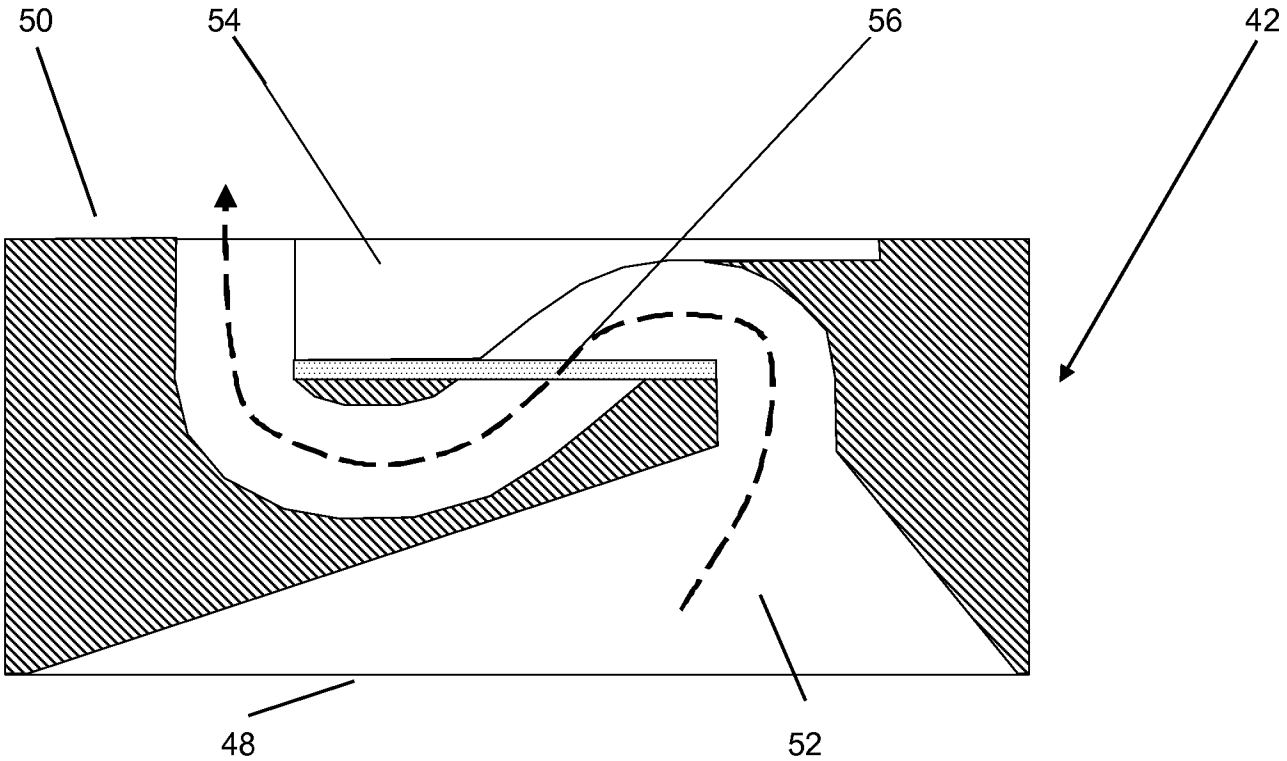
FIG. 5 shows yet another embodiment of an indicator device.

FIG. 5 shows an alternative embodiment for an indicator device 42, in which air path 52 leads from filter inlet side 48 via flow-through indicator 56 to filter outlet side 50. Thus, this configuration is similar to that shown in FIG. 3, but differs, for example, in the arrangement of flow-through usage indicator 56, whose entire surface is here oriented horizontally.

Figure 6:
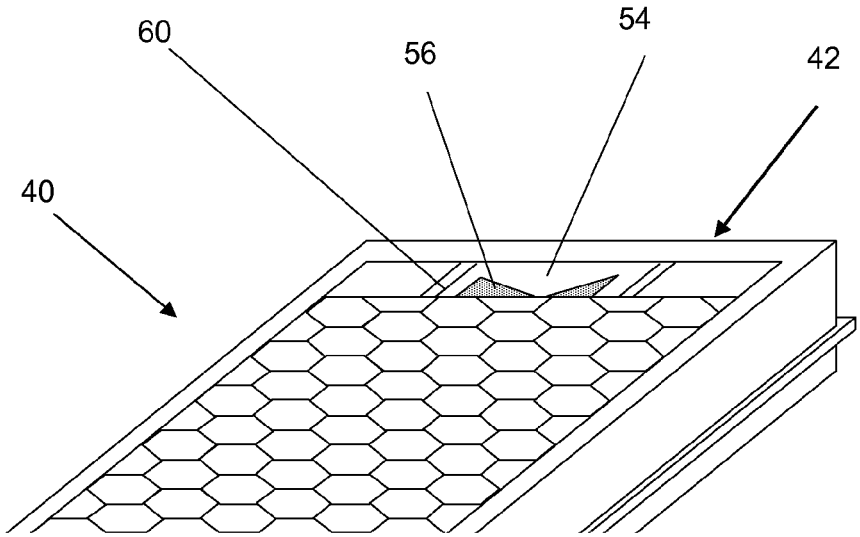
FIG. 6 schematically shows two perspective views of a filter including an indicator device.
Figure 6:
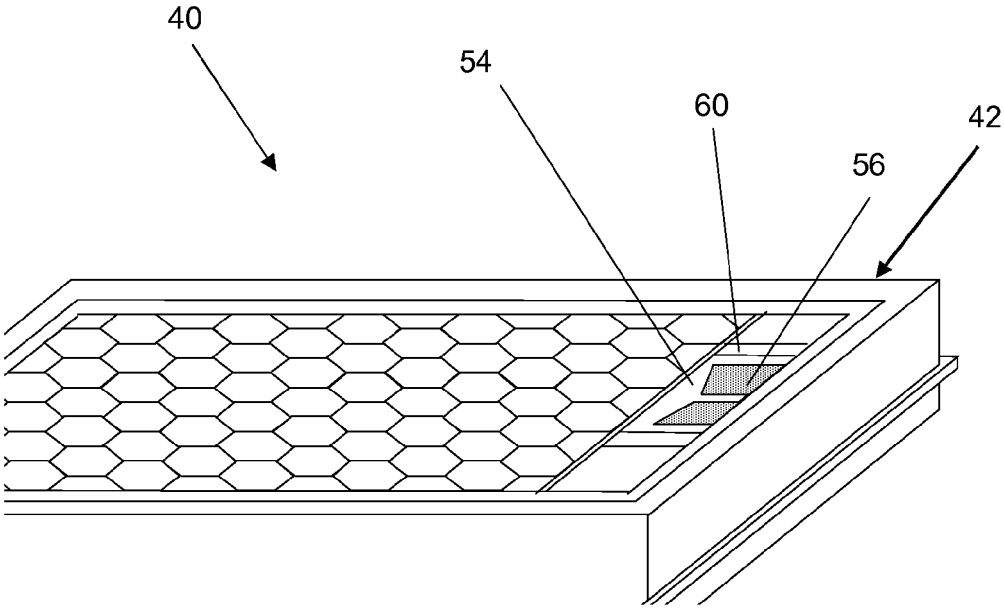

The upper and lower portions of FIG. 6 show, in schematic a simplified three-dimensional representation, a filter 40 having a laterally disposed indicator device 42. However, the only parts of the combined configuration of indicator device 42 and filter 40 that are visible here are an exhaust port 60 at the end of air path 52 (FIG. 2; FIG. 3; FIG. 4; FIG. 5) and usage indicator 56, which is located beneath a viewing window 54. In this configuration, filter 40 including indicator device 42 is also accessible for viewing by the user. Accordingly, based on the amount of material filtered by usage indicator 56 and the resulting change in color of usage indicator 56, the user is able to determine the degree of saturation of filter 40 and, if necessary, to replace the filter or have it replaced.

As an alternative, or in addition, to being visually checked by a user, usage indicator 56 may also be evaluated electronically, because its optical properties, in particular its reflective properties, change as the amount of filtered material increases. These optical properties can be evaluated using electronic sensor means operating in the manner of a reflective light barrier or the like.

In summary, the present invention provides a filter 40, in particular a filter 40 which functions as a vacuum cleaner exhaust filter 26 and includes an indicator device 42 which is acted upon by the air to be filtered and in which filtered material serves as an indicator, for example in that the filtered material deposits on a fibrous mat, or the like, which allows flow therethrough and acts as a usage indicator 56, and in that there, the filtered material represents or causes a change in color of usage indicator 56, which can be visually perceived and thus evaluated by a user.

The scope of the invention is defined by the claims and back-references used in the dependent claims refer to the further development of the subject matter of the main claim by the features of the respective dependent claim. In addition, they may also include independent inventions, whose creation is independent of the subject matters of the preceding claims, and are not to be understood as renouncing attainment of an independent protection of subject matter for the features thereof. Furthermore, with regard to an interpretation of the claims in the case of a more detailed concretization of a feature in a subordinate claim, it is to be assumed that a restriction of said kind is not present in the respective preceding claims.

While the invention has been particularly shown and described with reference to preferred embodiments thereof, it will be understood by those skilled in the art that various changes in form and details may be made therein without departing from the spirit and scope of the invention.

What is claimed is:

1. A filter comprising:

a filter medium;

a filter inlet side;

a filter outlet side;

an indicator device configured to be acted upon by air flow through the filter, the indicator device being disposed adjacent to the filter medium and extending from the filter inlet side to the filter outlet side, the indicator device including:

a first air path starting from the filter inlet side, a viewing window covering the air path on the filter outlet side, and a flow-through usage indicator configured to receive filtered material, the flow-through usage indicator being disposed in the air path and being visible beneath the viewing window on the filter outlet side.

2. The filter recited in claim 1, wherein the filter is configured as a vacuum cleaner exhaust filter.

3. The filter recited in claim 1, wherein the viewing window is configured to deflect air flowing in the first air path through the usage indicator.

4. The filter recited in claim 1, wherein the first air path extends from the viewing window to the filter inlet side through the flow-through usage indicator.

5. The filter recited in claim 4, wherein in a region of the filter inlet side, a downstream end of the first air path includes a channel section disposed parallel to the filter inlet side.

6. The filter as recited in claim 1, wherein the first air path extends to the filter outlet side through the usage indicator.

7. The filter recited in claim 1, further comprising a second air path symmetric to the first air path.

8. The filter recited in claim 7, wherein the second air path includes an additional usage indicator and an additional viewing window.

9. The filter recited in claim 7, wherein the second air path shares the viewing window and usage indicator with the first air path.

10. The filter recited in claim 7, wherein a separating layer is disposed between the first and second air paths.

11. The filter recited in claim 1, wherein the viewing window includes a lens.

12. A vacuum cleaner including a filter comprising:

a filter medium;

a filter inlet side;

a filter outlet side;

an indicator device configured to be acted upon by air flow through the filter, the indicator device being disposed adjacent to the filter medium and extending from the filter inlet side to the filter outlet side, the indicator device including:

a first air path starting from the filter inlet side, a viewing window covering the air path on the filter outlet side, and a flow-through usage indicator configured to receive filtered material, the flow-through usage indicator being disposed in the air path and being visible beneath the viewing window on the filter outlet side.

13. The vacuum cleaner recited in claim 12, wherein the filter is configured as a vacuum cleaner exhaust filter.

14. The vacuum cleaner recited in claim 12, wherein the viewing window is configured to deflect air flowing in the first air path through the usage indicator.

15. The vacuum cleaner recited in claim 12, wherein the first air path extends from the viewing window to the filter inlet side through the flow-through usage indicator.

16. The vacuum cleaner recited in claim 15, wherein in a region of the filter inlet side, a downstream end of the first air path includes a channel section disposed parallel to the filter inlet side.

17. The vacuum cleaner as recited in claim 12, wherein the first air path extends to the filter outlet side through the usage indicator.

18. The vacuum cleaner recited in claim 12, wherein the indicator device of the filter includes a second air path symmetric to the first air path.

* * * * *